US007284804B2

(12) United States Patent
Jones et al.

(10) Patent No.: US 7,284,804 B2
(45) Date of Patent: Oct. 23, 2007

(54) INTERLEAVING APPARATUS AND METHODS FOR RADIAL PRINTING

(75) Inventors: Randy Q. Jones, Sunnyvale, CA (US); Michael R. Thompson, Los Gatos, CA (US); Carl E. Youngberg, Mapleton, UT (US)

(73) Assignee: Elesys, Inc., Sunnyvale, CA (US)

( * ) Notice: Subject to any disclaimer, the term of this patent is extended or adjusted under 35 U.S.C. 154(b) by 242 days.

(21) Appl. No.: 10/935,805

(22) Filed: Sep. 7, 2004

(65) Prior Publication Data

US 2005/0078142 A1 Apr. 14, 2005

Related U.S. Application Data

(63) Continuation-in-part of application No. 10/125,681, filed on Apr. 18, 2002, now Pat. No. 6,786,563.

(60) Provisional application No. 60/566,468, filed on Apr. 28, 2004, provisional application No. 60/284,847, filed on Apr. 18, 2001.

(51) Int. Cl.
*B41J 3/00* (2006.01)
*B41J 29/38* (2006.01)

(52) U.S. Cl. ..... 347/2; 347/9; 347/14

(58) Field of Classification Search ..... 347/2, 347/8, 9, 14, 16, 19, 101, 104, 107; 358/1.11, 358/1.18, 3.2; 346/137; 101/35
See application file for complete search history.

(56) References Cited

U.S. PATENT DOCUMENTS

| | | | |
|---|---|---|---|
| 4,110,594 | A | 8/1978 | May |
| 4,556,966 | A | 12/1985 | Bricot et al. |
| 4,721,969 | A | 1/1988 | Asano |
| 4,739,415 | A | 4/1988 | Toyono et al. |
| 4,872,026 | A | 10/1989 | Rasmussen et al. |
| 4,967,286 | A | 10/1990 | Nomula et al. |
| 5,019,838 | A | 5/1991 | McKinley et al. |
| 5,041,846 | A | 8/1991 | Vincent et al. |
| 5,115,250 | A | 5/1992 | Harmon et al. |
| 5,154,957 | A | 10/1992 | Yamada et al. |
| 5,317,337 | A | 5/1994 | Ewaldt |
| 5,444,687 | A | 8/1995 | Okumura |
| 5,468,076 | A | 11/1995 | Hirano et al. |
| 5,518,325 | A | 5/1996 | Kahle |
| 5,597,590 | A | 1/1997 | Tanimoto et al. |
| 5,634,730 | A | 6/1997 | Bobry |
| 5,656,229 | A | 8/1997 | Tanimoto et al. |

(Continued)

FOREIGN PATENT DOCUMENTS

| | | | |
|---|---|---|---|
| EP | 140384 | A2 | 5/1985 |
| EP | 0952725 | A2 | 10/1999 |

(Continued)

*Primary Examiner*—Stephen Meier
*Assistant Examiner*—Leonard Liang
(74) *Attorney, Agent, or Firm*—Beyer Weaver LLP

(57) ABSTRACT

Methods and apparatus for interleaved printing of individual ink objects at target print sectors disbursed around an annular surface on a circular spinning media such as on a CD, dynamically during the radial printing process, are described. Mechanisms for interleaving printing during the radial printing process, enabling the use of commercially available ink jet pens for radial printing directly on CD devices at greater than 2× rotation speeds, and thus reducing pen limitations in firing frequency and recovery time, are disclosed.

23 Claims, 7 Drawing Sheets

U.S. PATENT DOCUMENTS

| | | | |
|---|---|---|---|
| 5,918,540 | A | 7/1999 | Fischer |
| 5,967,676 | A | 10/1999 | Cutler et al. |
| 5,978,000 | A | 11/1999 | Levine |
| 6,019,151 | A | 2/2000 | Wen et al. |
| 6,020,977 | A | 2/2000 | Kim |
| 6,074,031 | A | 6/2000 | Kahle |
| 6,202,550 | B1 | 3/2001 | Lee et al. |
| 6,264,295 | B1 | 7/2001 | Bradshaw et al. |
| 6,386,667 | B1 | 5/2002 | Cariffe |

FOREIGN PATENT DOCUMENTS

| | | | |
|---|---|---|---|
| JP | 06031906 | A | 2/1994 |
| JP | 07101039 | | 4/1995 |
| JP | 09265760 | | 7/1997 |
| JP | 09265760 | | 10/1997 |
| JP | 09306144 | A | 11/1997 |
| JP | 2002292939 | A | 10/2002 |
| JP | 20022298545 | A | 10/2002 |
| JP | 2003019828 | A | 1/2003 |
| WO | WO00/32399 | | 6/2000 |
| WO | WO 0032399 | | 6/2000 |

INTERLEAVING APPARATUS AND METHODS FOR RADIAL PRINTING

CROSS REFERENCE TO RELATED APPLICATIONS

This application is a continuation-in-part of U.S. application Ser. No. 10/125,681, filed Apr. 18, 2002, now U.S. Pat. No. 6,786,563, which claims the benefit of U.S. Provisional Application No. 60/284,847 filed Apr. 18, 2001, entitled INTERLEAVING METHODS FOR RADIAL PRINTING, by Randy Q. Jones. This application relates to U.S. application Ser. No. 10/848,537 filed May 17, 2004, entitled ENHANCING ANGULAR POSITION INFORMATION FOR A RADIAL PRINTING SYSTEM, by Struk et al. This application also relates to U.S. application Ser. No. 60/566,468 filed Apr. 28, 2004, entitled RADIAL SLED PRINTING APPARATUS AND METHODS, by Lugaresi et al. This application also relates to U.S. Pat. No. 6,264,295, issued Jul. 24, 2001, entitled RADIAL PRINTING SYSTEM AND METHODS by George L. Bradshaw et al. These referenced applications and patents are incorporated herein by reference in their entirety for all purposes.

FIELD OF THE INVENTION

The present invention relates to fluid dispensing devices and methods for printing on spinning circular media. More particularly, it concerns mechanisms for placing ink on spinning circular media discs.

BACKGROUND OF THE INVENTION

In the art of dispensing fluidic ink objects as it applies to radial printing, there is a need to place ink objects efficiently onto the spinning circular media to effectively use the mechanisms of radial printing. Radial printing generally includes dispensing ink onto a media at a particular radius of the media while the media is rotating. Additional challenges exist with physical limitations and interactions of the devices employed, such as with the fluid dispensing device, herein alternately termed "print pen" or "pen," wherein the maximum frequency of the pen's firing cycle, in terms of both the pen's overall fluid firing capacity and recovery time, increase proportionally as spinning rates of CD devices increase.

Commercially available ink jet print pens have inherent limitations as it relates to media spin rates, or in other words, the speed at which the surface to be printed moves past the pen. Two limitations are factors in maximizing print speed of a device using these devices:

(1) The pen recovery latency, after firing, to allow time for the meniscus to recover and the pen ink well to refill, and (2) The maximum pen firing frequency, at which the pen can repetitively fire a burst of nozzles.

For example, a typical ink jet has a pen firing frequency of 12 kHz and a pen recovery time of about 83 μs, which is adequate to keep pace and print the media consecutively printing 20,480 instantaneous angular counts per rotation for up to about the normal 2× CD media spinning rates of 720 RPM. With even higher rotation speeds, the required pen firing frequencies to print consecutively on the media exceed the capability of the pen.

In other words, the pen's firing frequency and pen recovery latency is currently a limiting factor in the speed that can be achieved in radial printing, wherein CD rotation speeds may substantially exceed the pen's capabilities. In view of the foregoing, there is a need to solve the unique problems associated with printing on a spinning CD. Additionally, printing mechanisms for overcoming a ink pen's firing frequency are needed.

SUMMARY OF THE INVENTION

Accordingly, the present invention provides mechanisms for increased radial printing speeds without a requirement to increase the pen's frequency capability, thus enabling the use of standard commercially available pens in radial printing devices.

The present invention includes several embodiments for placing ink on spinning circular media to solve problems with physical printing limitations, such as pen maximum frequency and pen recovery latency as spinning rates increase. Normal inkjet pen frequency is adequate to keep pace with instantaneous angular velocities for up to twice the spinning media spinning rates. However, with higher rotation speeds, the required pen frequencies can exceed the capability of the pen. Thus, mechanisms are provided in which printing may be accomplished without a requirement to increase the pen frequency capability.

In general terms, this invention uses interleaved radial printing to solve a problem inherent to optimizing the printing time and addresses physical printing limitations, such as pen maximum frequency and pen recovery latency time while printing to spinning circular media. Interleaved radial printing generally includes shifting the firing time to when the print pen is directly over the area to be printed, which herein will be called the "target sector." The print pen is activated at a particular time to produce best results, which herein will be called the "firing zone," which can be visualized as an arch-shaped swath of a limited angular length on the surface of the rotating circular media.

The present invention provides one or more of the following mechanisms to remedy the above and other issues related to radial printing on rotating circular media through the use of interleaved radial printing:

In one general embodiment, the print pen is given shorter band of data to print, interspersed on the same track, which is at the same radial position on the media. In this situation, interleaving operates such that the print pen reprints in more than one rotation: at one and a fraction of a rotation or in two or more rotations. Limitation with pen recovery latency time is addressed through this technique.

In a second general embodiment, the rotation speed of the media may substantially exceed the print pen-firing rate such that the target sector passes several times under the pen-firing zone during any given radial position. In this situation, the print pen may fire at an angular position to optimize the placement of an ink dot onto the media at a rate commensurate with the firing frequency of the print pen. In this way, the print pen can place ink on the surface during any one of subsequent successive rotations, piecing the individual image elements together much like a patchwork quilt. This mechanism may be used to address radial printing limitations such as maximum pen frequency.

In a specific implementation, interlaced timing of all pen firing is directed by the feedback information from a rotary encoder and the pen controller.

In a specific embodiment, a method of printing onto a rotating media is disclosed. The media is rotated at a selected rotation speed. Ink is dispensed onto a first sector of a radial print track of the rotating media during a first rotation of the media. Ink is also dispensed onto a second sector of a radial print track of the rotating media during a second rotation of the media. The radial print track has a larger area than either the first sector or the second sector.

In a specific aspect, ink is dispensed onto a plurality of first sectors of the radial track of the rotating media during the first rotation of the media. In a further aspect, ink is dispensed onto a plurality of second sectors of the radial track of the rotating media during the second rotation of the media. In another specific implementation, the rotation speed is selected so that ink is dispensed onto a first sub-sector and not onto a second sub-sector of the first sector during the first rotation, and ink is dispensed onto the second sub-sector of the first sector during the second rotation. Additionally, the first sub-sector of the first sector is contiguous with the second sub-sector of the first sector. In a related implementation, the rotation speed is selected so that ink is dispensed onto a first sub-sector and not onto a second sub-sector of the second sector during the second rotation, and ink is dispensed onto the second sub-sector of the second sector during the first rotation. The first sub-sector of the second sector is also contiguous with the second sub-sector of the second sector.

In a specific implementation, the second rotation immediately follows the first rotation. In another aspect, a distance between the first and second sectors is equal to a duration of time required by an ink dispensement mechanism to recover after dispensing ink onto the first sector. In a preferred embodiment, the media is an optical recording media disc, such as a CD. In another implementation, the first and second sector are each an arch-shaped swath of a limited angular length on a surface of the rotating media.

In an alternative embodiment, the invention pertains to a printing system for radially printing onto a rotating media. The printing system generally includes a rotation mechanism for rotating the media at a selected rotation speed and a dispensement mechanism for dispensing ink onto a media while the media is rotating under the dispensement mechanism. The printing system further includes a controller for causing the dispensement mechanism to perform one or more of the above described method embodiments.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF SPECIFIC EMBODIMENTS

The present invention will now be described in detail with reference to a few preferred embodiments as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

For the scope of this invention, the terms "CD" and "media" are intended to mean all varieties of optical recording media discs, such as CD-R, CD-RW, DVD-R, DVD+R, DVD-RAM, DVD-RW, DVD+RW and the like.

The interleaving mechanisms described herein may be integrated within any suitable radial printer. Several embodiments of radial printers are further described in above reference U.S. Pat. No. 6,264,295, by Bradshaw et al, issued Jul. 24, 2001 and U.S. patent application Ser. No., having application number 60/284,847, filed Apr. 18, 2001, entitled INTERLEAVING METHODS FOR RADIAL PRINTING, by Randy Q. Jones, which application is incorporated herein by reference in its entirety for all purposes.

Figure 3:
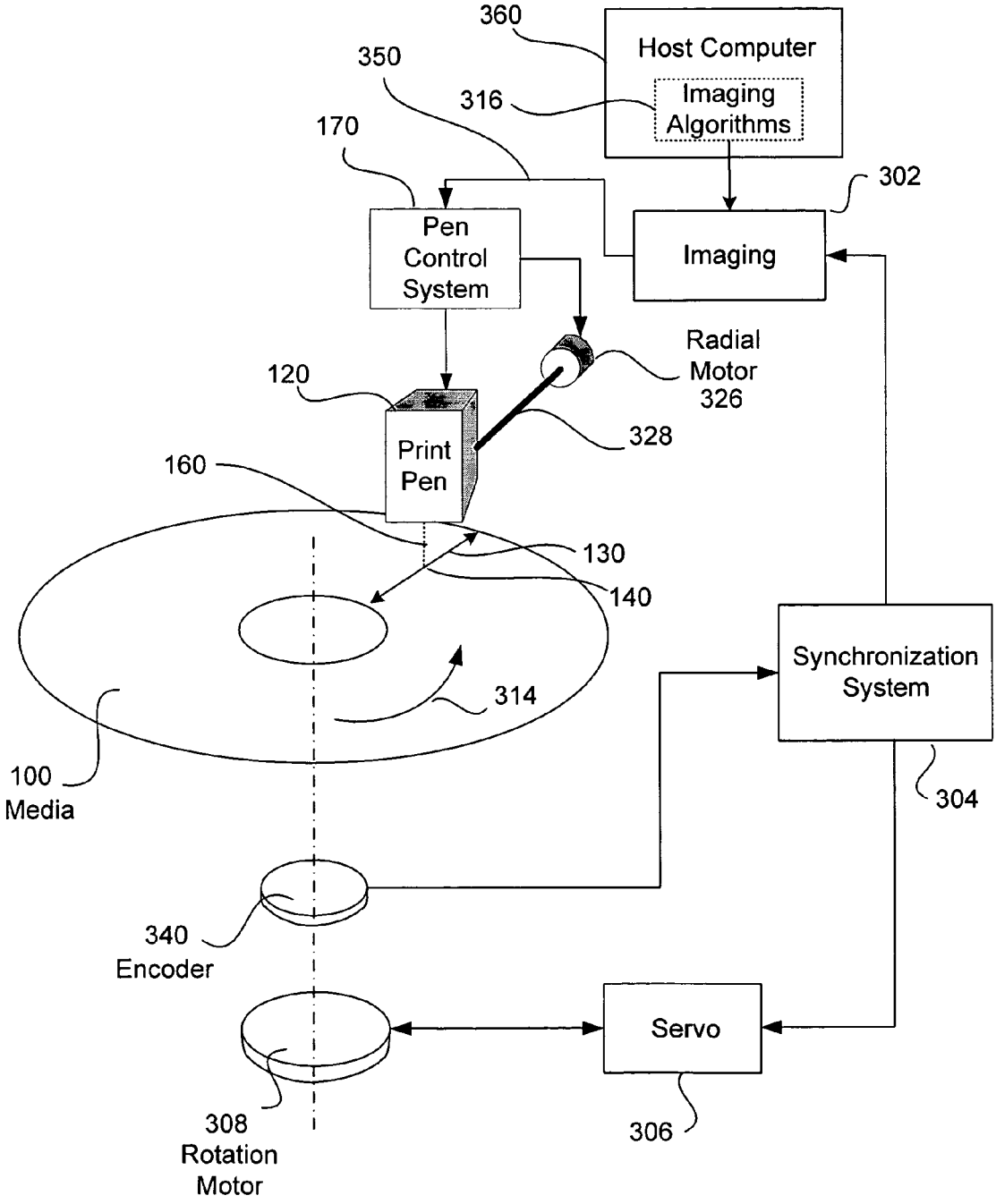
FIG. 3 represents a radial printing system in which the mechanisms of the present invention may be implemented.

FIG. 3 represents a radial printing system in which the mechanisms of the present invention may be implemented. Print pen 120 moves along a radial path 130 by means of a radial motor 326 and actuator 328, while the media 100 spins 314 underneath the pen 120, which fires in along a trajectory 160 to place ink on the disk at a specific target location, also referred to as the print zone 140. The Pen control system 170 controls the positioning and firing of the pen 120. Images from the imaging algorithms 316 are prepared by the imaging system 302 and synchronized with the synchronization system 304 with the rotational information from the encoder 340 and in conjunction with the rotation motor 308 and servo 306. The pen 120 thereby synchronously prints radially to place ink objects at the target print zone 140.

Printing on the rotating media 100 at a given location 140 at a given time often has limitations. In the illustrated embodiment shown in FIG. 1, a typical print pen 120 has two basic speed limitations: the maximum firing frequency and the recovery time. Maximum firing frequency is the fastest rate at which the pen 120 may be fired. "Recovery latency time" is the time that the pen must recover after a burst of firing the pen a plurality of cycles at maximum frequency. To accommodate these kinds of limitations, embodiments of the present invention provide mechanisms for interleaving to minimize print time or, as a corollary, allow printing on rotating media at a higher rotating speed than the print pen would conventionally constrain.

Delayed-Printing Interleaving

In one embodiment, the interleave mechanisms described herein for radial printing use a technique of delayed radial printing, termed "delayed printing" herein, in which the printing of a particular part of the image is delayed until a subsequent partial or single rotation, or plurality of rotations, of the media makes the "target sector" or "print zone" available to the pen for printing repetitively. Several different embodiments of interleaving could be used in combination or individually to overcome limitations imposed by the print pen.

Figure 1:
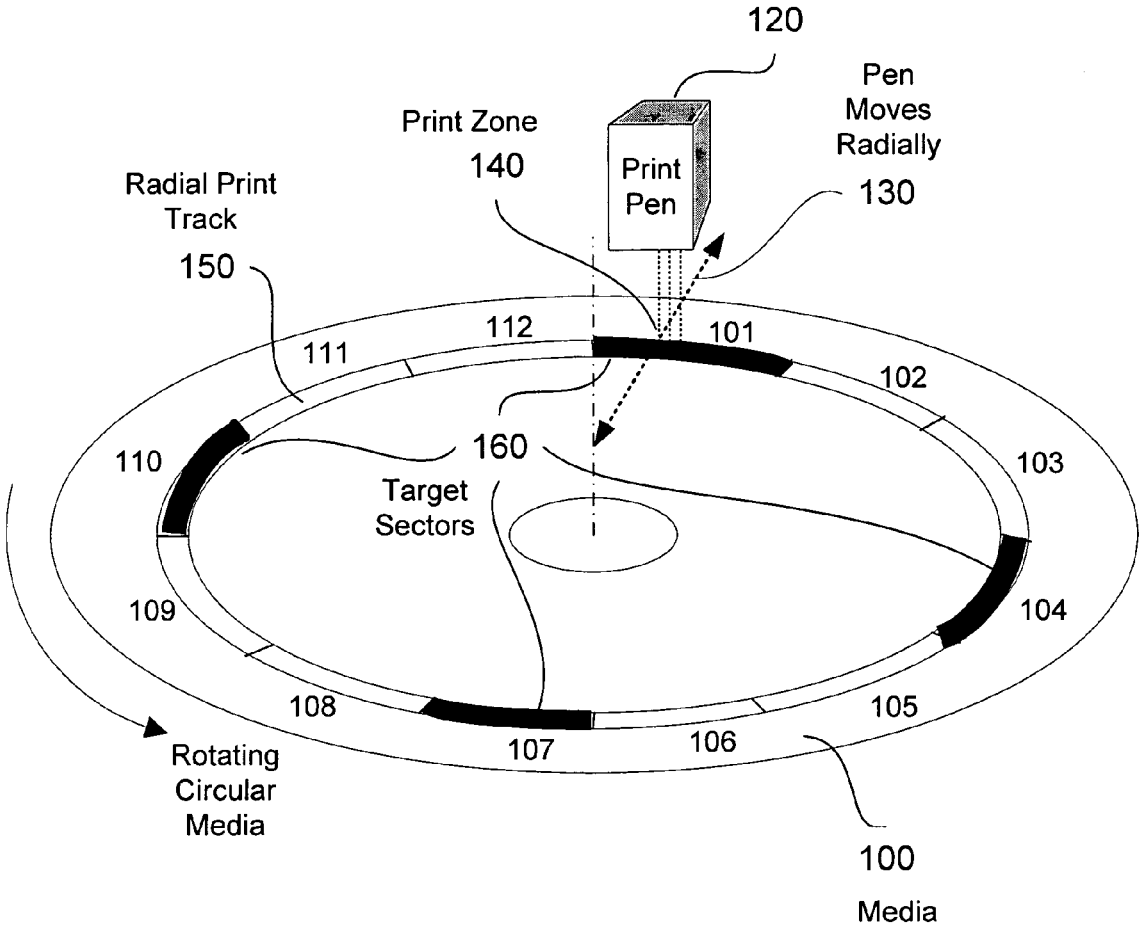
FIG. 1 represents a portion of a radial printing system with media and inkjet pen, depicting the target sectors for interleaved printing in accordance with one embodiment of the present invention.

FIG. 1 illustrates in more detail the principle of the interleaving mechanisms as applied to radial printing in accordance with one embodiment of the present invention. This embodiment uses interleaving where rotation speed exceeds pen recovery latency time for continuous pen operations, and thus maximizes the pen firing frequency to fire continuously throughout each target sector 160, such that any two consecutive target sectors 101 and 104 may have a plurality of interlude sectors, such as 102 and 103, spaced between each target sector 160. The print pen 120 fires during radial printing. Print pen 120 is mounted over media 100, such that it moves radially along path 130 while the media 100 spins underneath, and prints to a radial print track 150 containing target sectors 160 to print when each respective sector 160 comes under the pen in the print zone 140. Since the same print zone 140 on the rotating media passes under the same print pen 120 repeatedly, these rotational properties can be used to operational advantage, solving the print pen firing cycle limitation problem.

Sectors 160 need not be of equal size or be equally divisible into the circumference of the media to affect delayed radial printing. In such case, the imaging system 302 properly prepares the print instructions 350 for the pen control system 170.

Although delayed printing does not necessarily have to occur on a periodic basis, in some cases periodic delays are useful. Such periodic delays are termed "interleaving" herein. Alternatively, an example of non-periodic delayed printing is a case in which the host computer 360 generating the imaging algorithms 316 is backlogged and cannot deliver data to the imaging system 302 at the necessary time. By delaying the printing one or a plurality of rotations, the host computer 360 generating the imaging algorithms 316 is provided the additional time necessary to perform its computational processing. The delay does not affect output print quality, since the delay is synchronized until the next print sector rotates into the print zone 140. One adverse impact of using too much printing delay is that it may lengthen the overall print duration to print the entire media image.

As shown, in FIG. 1, in one embodiment, for the target sectors 160, one permutation of pen firing fires pen 120 first at sector 101 under print zone 140, then at sector 104, then at sector 107, and finally at sector 110. Alternatively, another permutation of pen firings may be done in the sector order of 101, 107, 104, and 110, respectively. In another permutation of pen firings, the firing order may be done in sector order 101, 110, 107 and 104. In sum, the order of firing, its permutations and combinations in any of a plurality of rotations necessary to cycle through the target sectors 160 for each track 150 is unrestricted. That is, the order of sector firing can assume any permutation or combination of contiguous or noncontiguous target sectors 160 as to affect optimal firing of the print pen 120. Thus, the term "delayed printing" is used herein to describe the target sector printing delay in order to optimized the pen firing, such as the sequence of sectors 101, 104, 107, and 110, respectively.

To complete printing an image on the entire media 100 surface, the host computer 360 in FIG. 3 and pen control system 170 respectively and similarly prepare images and issue the next set of target sectors to be printed, such as sectors 102, 105, 108 and 111, then finally sectors 103, 106, 109 and 112, until all sectors are printed in the band track 150, where upon the print pen 120 is moved by actuator motor 326 and actuator 328 to a new radius and thus start a new radial print track 150; this process repeats for a plurality of radial print tracks 150 on the media 100 surface until the entire surface is printed with an image.

High-Spin-Rate Interleaving

Figure 2:
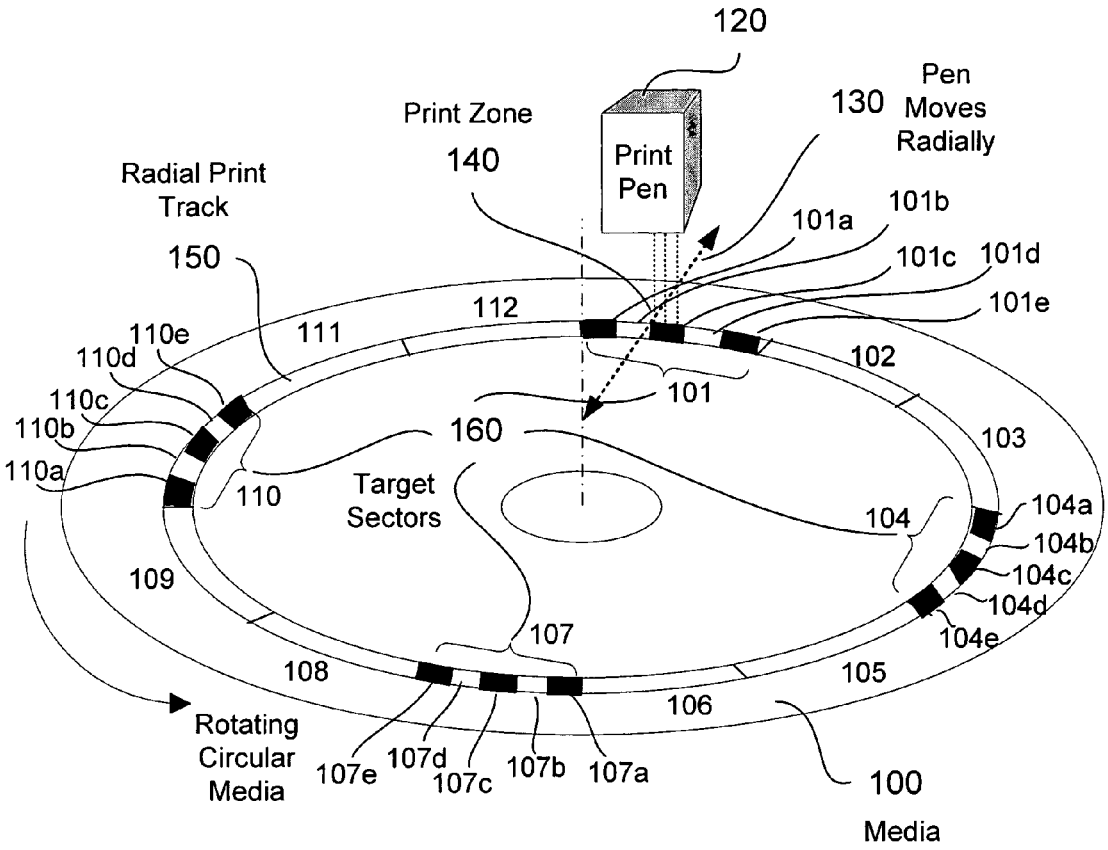
FIG. 2 represents a portion of a radial printing system with media, depicting the sub-sectors for interleaved printing, enabling printing at excessive rotation speeds in accordance with one embodiment of the present invention.

In another embodiment, shown in FIG. 2, a case where the media rotation speed substantially exceeds the print pen-firing rate is depicted. This embodiment uses interleaving to maximize the pen firing frequency with excessive rotational rates, not withstanding the limitations thereof, by using a plurality of sub-sectors, spaced apart for pen recovery latency time. The target sectors 160 sector pass several times under the pen firing zone during any given radial position and thus are further subdivided into partial or sub-sectors, such as 101*a* or 107*c*, to allow for a pen 120 to fire at an instantaneous angular position to optimize the placement of ink dot onto the media at a rate approaching that of or commensurate with the firing frequency of the print pen 120. In this way, the print pen 120 can place ink on the surface 100 at each sub-sector, such as 101*a* or 107*c*, during any one of subsequent plurality of successive rotations, and thus piece together the plurality of individual image elements into sub-sectors, much like a patchwork quilt. As the pen typically must wait a specific length of time to recover before firing again, interleaving is ideal for solving this recovery time problem.

In a specific implementation, sub-sectors 101*a*, 101*c*, and 101*e* print in succession, followed by sub-sectors 104*a*, 104*c*, and 104*e*, then sub-sectors 107*a*, 107*c*, and 107*e*, and finally sub-sectors 110*a*, 110*c*, and 110*e* print, completing the first pass of burst printing in the first or in a plurality of rotations. Also done in the first succeeding or in a plurality of succeeding rotations and during the next burst printing pass, the gaps left in between the previously printed sub-sectors are printed, such that sub-sectors 101*b* and 101*d* print in succession, followed by sub-sectors 104*b* and 104*d*, then sub-sectors 107*b* and 107*d*, and finally sub-sectors 110*b* and 110*d*, completing the second pass of printing and thus also the first set of target sectors 160 in the track 150 to be printed.

In this second embodiment, to complete printing of an image on the entire media 100 surface, the host computer 360 in FIG. 3 and pen control system 170 respectively and similarly prepare images and issue the next set of target sectors to be printed, such as sectors 102, 105, 108 and 111, then finally sectors 103, 106, 109 and 112, until all sectors are printed in the band track 150. For each group of sectors, interleaving printing is then utilized to print onto interleaved sub-sectors of each sector. After the printing within a particular band of sectors (e.g., 150) is complete, the print pen 120 is moved by actuator motor 326 and actuator 328 to a new radius and thus starts a new radial print track. This process repeats for a plurality of radial print tracks on the media surface 100 until the entire surface is printed with an image. Similar to the first embodiment, a plurality of permutations and combinations of sectors and sub-sectors in any of a plurality of rotations necessary to cycle through a plurality of target sectors 160 without restriction may be used to print the media 100 in this fashion.

In the radial printing environment, the print zone 140 at which a given part of the image may be printed under the pen 120 is available on a periodic basis, the time of which depends on the rotating speed of the media 100. Given print pen frequency limitations, there are physical instances wherein the rotation speed of the media is too fast for the head to print the image contiguously. Thus, interleaving the print positions is a solution to this problem.

In a specific embodiment, interleaving could be used to decrease the head frequency requirements by a factor of two if every other print position, i.e., 101, 103, 105, 107, 109, and 111, respectively, is printed on the first rotation, and the omitted print sectors, 102, 104, 106, 108, 110, and 112, respectively, are printed on the second rotation.

Given the pen recovery latency time limitation, a print pen 120 may not be physically ready to print the next sector after printing a previous sector. In this case, interleaving of the target sectors 160 can address this problem. Matching up the next available sector for print minimizes slack rotating time wherein nothing is printed.

In a specific embodiment, rather than waiting an entire rotation to print the next contiguous print zone, the sectors 160 are printed out of sequence, such as sectors 101, 110, 107 and 104. For example, if the recovery time is the time for one zone to rotate under the print pen, the interleave factor would cause printing of alternate zones on the first rotation, and filling in the zones on the second rotation. Thus, print time is two rotations, rather than when not optimized, many more rotations are needed, up to a plurality of all sectors 101-112 in each track (e.g., 150).

In another specific embodiment, non-periodic delays can be used to address limitations imposed by the performance of the host computer and associated communication links. If the data from the host is not available at the time that the target sector 160 is under the pen 120, the firing will be delayed one or more rotations until the data are ready. Such delays will not affect print quality, but will affect print duration.

The following mechanisms (described in detail above) can be combined together in any suitable combination to provide more complete print coverage at higher rotating speeds in a particular implementation:

1. The host computer limitations may result in delays in image processing and output to the pen, which may be overcome by delayed printing so that sectors are printed in several rotations;
2. Print pen frequency limitations and higher rotating speed rates can be handled using print position interleaving; and
3. The print pen recovery latency time limitations can be overcome by interleaving zones.

Figure 4:
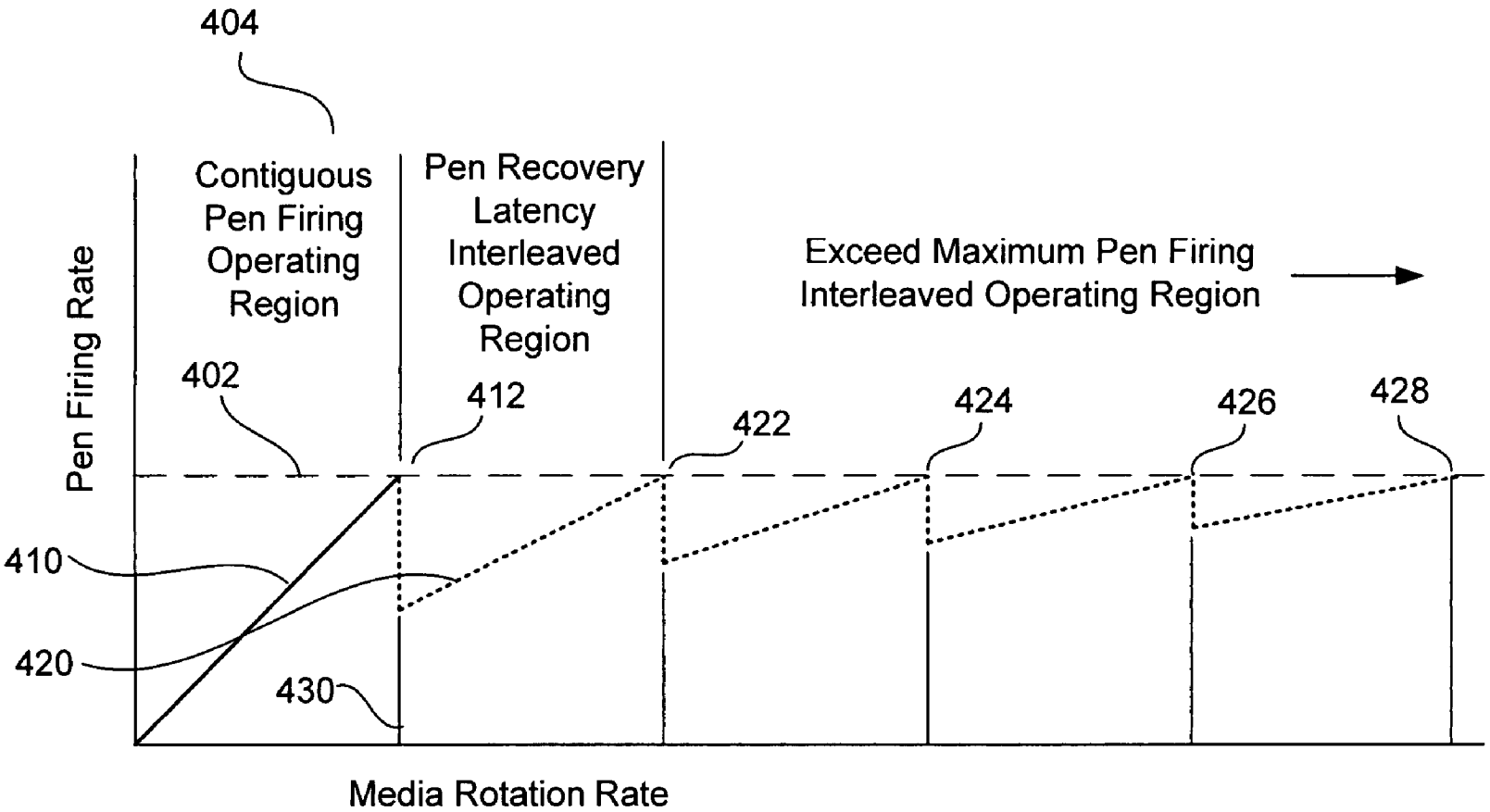
FIG. 4 represents a chart depicting the optimal rotation performance regions for interleaved radial printing.

Actual experimental results with these techniques in prototype of this inventor's design bears out the merits of interleaving for radial printing. For example, FIG. 4 shows a chart depicting the optimal rotation performance regions for interleaved radial printing. Region 404 is the rotation rate at which continuous pen firing 410 occurs, printing all sectors consecutively and contiguously. At point 412, the maximum firing rate 402 of the pen is reached. Without interleaved printing 420, rotation speed 430 would be the final limit for radial printing the media. However, with interleaving, more operating regions are available. For example, if rotation rate 430 was 1× CD spin rate and rotation rate 422 was 2× CD spin rate, then the print speed is substantially identical between contiguous printing 410 versus interleaved printing 420 at points 412 and 422, respectively. At each CD spin rate change, such as 424, 426, 428 and the like, interleave printing 420 is optimal for printing at a substantially similar print speed as the contiguous printing 410, as slow spin rates. This diagram is shown for illustration purposes since the actual optimal rotation speeds may vary due to the selection of the rotation angular count encoder used for interleaved radial printing 420.

Figure 5:
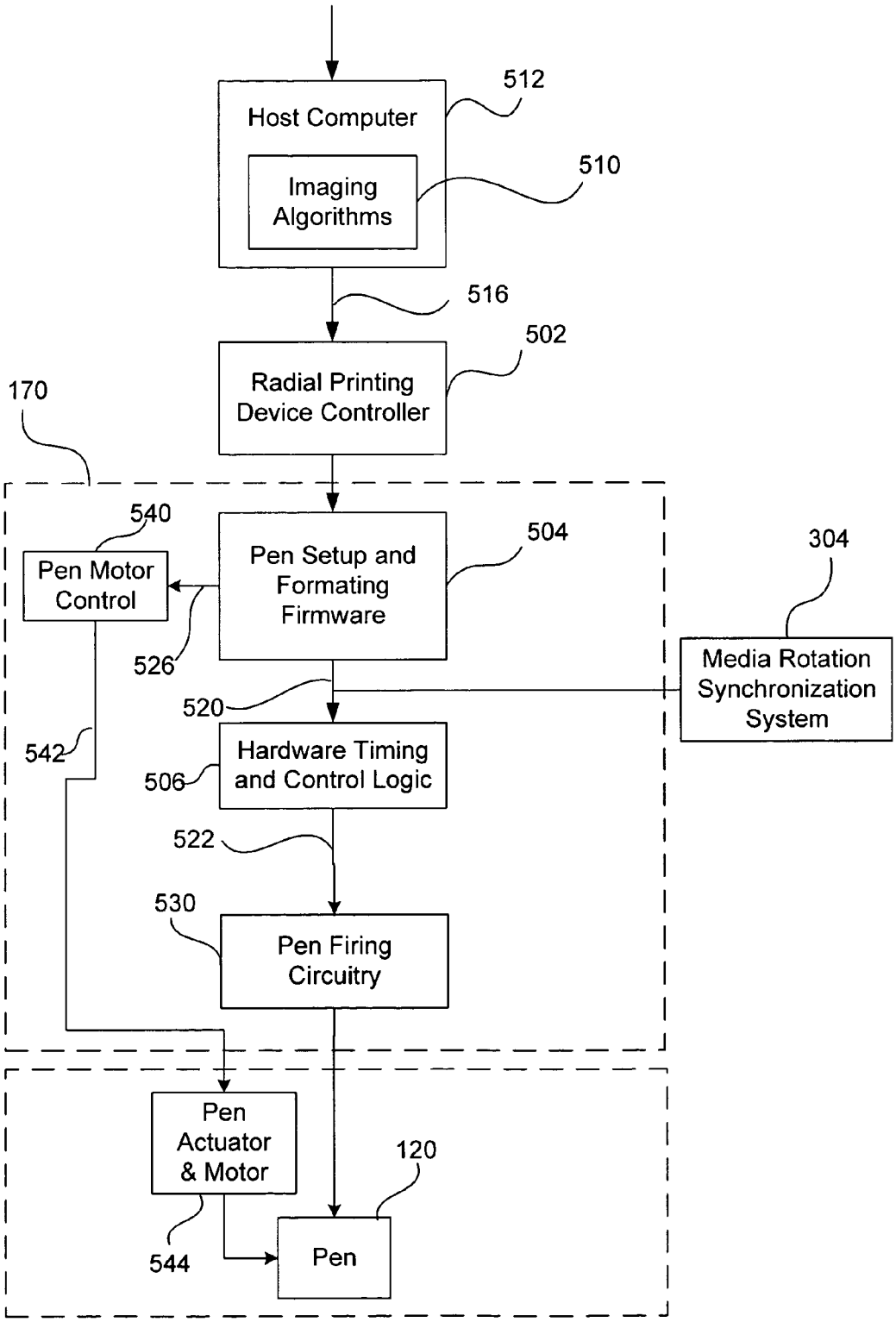
FIG. 5 represents a block diagram of the pen control system in a radial printing system in accordance with one embodiment of the present invention.

FIG. 5 shows a block diagram of a mechanism for precisely controlling pen firing in accordance with one embodiment of the present invention. In the illustrated embodiment, precise control of the pen is obtained though a combination of analog and digital hardware logic circuits, firmware and host-based software, forming a pen control system 170. Of course, any suitable combination of hardware, firmware, and software may be utilized to implement pen firing control. First the firing time is predicted by the host computer 512 image rendering algorithms 510. Next, a command stream 516 is sent to the radial printing device controller 502, which in turn passes the instructions to the pen and formatting firmware 504. This firmware 504 formats a hardware command stream 520 for the hardware timing and control logic 506, commands 526 the pen motor control 540 to in turn command 542 the pen actuator and motor 544 to move the head assembly 420 to the target print track 150 (e.g., FIG. 1 or 2). Thereafter, the firmware 504 sets up the hardware timing and control logic 506 registers and commands 522 the pen 120 to fire in concert with the media rotation synchronization system 304 inputs, to assure the correct instantaneous angular position for the print zone 140 (e.g., FIG. 1 or 2). These control signal commands 522 are issued to the pen firing circuitry 530, whereupon the pen 130 then fires the ink droplets in the correct trajectory 160 (e.g., FIG. 3) to impinge at the print zone 140.

To date, interleaving has effectively allowed optimizing the printing a onto a CD type media from 100 RPM to over the 2× maximum rate of 720 RPM using a pen with a 12 kHz maximum firing frequency. The above described embodiments of the present invention address one or more of these areas:

(1) Provides a mechanism for radially printing CD discs, or other media type, faster than the physical firing cycle-time limitations of the print pen.

(2) Minimizes the limitations on radial printing when increasing CD recording device speeds (or other device type speeds) for radial printing devices that incorporate a CD device to affect spinning of the media.

(3) Enables integration of radial printing on CD recording devices that spin faster than the print pen physical cycle time, and thus enables use of ordinary ink jet pens in said radial printing.

One advantage of the printing system disclosed herein is that in as much as printing radially allows for multiple passes over the same point on the spinning media, a plurality of opportunities exists to print onto the media surface as it spins underneath the print pen. By employing the mechanisms of interleaving for radial printing, the media can be printed independently of the spinning rate, notwithstanding the physical print pen firing limitations. Thus, a device can be fashioned that merges a radial printer, which would more optimally print to a more slowly rotating speed CD, with an CD recording device, which record and spins substantially faster.

Fill-Clock Interleaving

In another embodiment, interleave printing is used to further refine and optimize individual pen nozzle firing order with respect to the firing zone. By their inherent design, commercially available ink jet pens are not optimized when used for radial printing applications. Such commercially available ink jet pens are fashioned from semiconductor materials and arranged with a plurality of nozzles in tight proximity (see FIG. 6). Usually the nozzles form a distinct pattern dictated by, among other things, the design goal to optimize nozzle firing during Cartesian-system-based printing and constrained by the material physics and thermal properties of the thermal or piezo materials selected for use.

This configuration is also inherently a constraint to radial printing using commercial ink jet pens, because the nozzle optimizations typically designed into these ink jet pens are optimized for printing orthogonally, where the pen is swept across one axis while the media processes perpendicularly under the pen. Nozzles are physically configured or aligned to be fired in orthogonal groupings, usually to minimize thermal overload and maximize orthogonal coverage over the printed media surface area.

In contrast, radial printing demands ink jet pens optimized to print in a polar coordinate system, in which the pens should be optimally configured with nozzles aligned parallel to the radial axis and/or perpendicular to the annular axis. Commercially available ink jet pens typically are fired in a grid-like fashion arranged or addressed in rows and columns. While this pen nozzle configuration could be reasonably used for radial printing, the mapping of the rows and column addressing for orthogonally optimized printhead nozzles often results in peculiar pen nozzle firing orders when used for radial printing and usually non-optimal, resulting in extra rotations of the media to ensure all nozzles have had an opportunity to fire in the firing zone.

Figure 6:
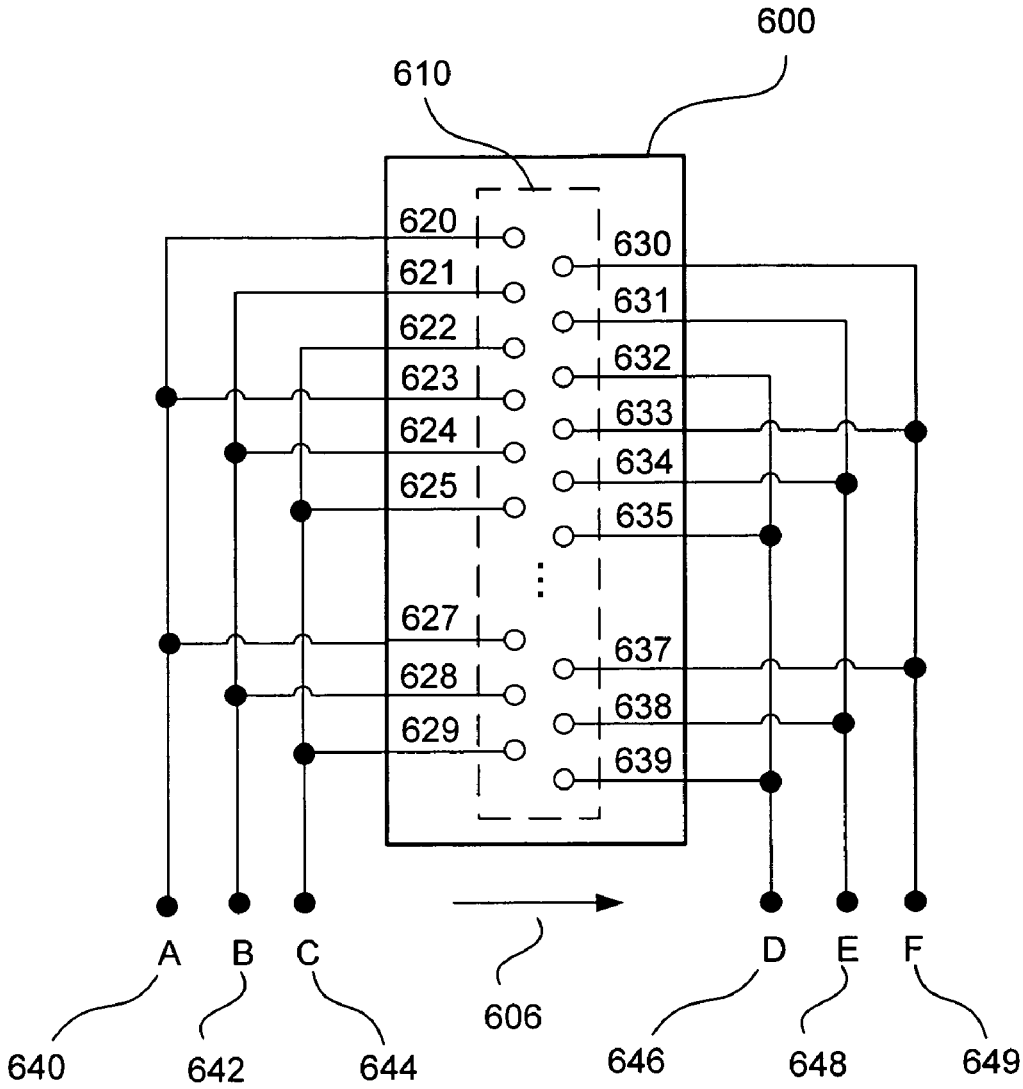
FIG. 6 represents an ink jet pen nozzle face plate, depicting nozzle pattern arrangements with associated addressing interconnections for one embodiment of the present invention.

Shown in FIG. 6 is a representative figure for a pen nozzle pattern optimized for Cartesian printing, such that nozzles are arranged in an orthogonal pattern relative to the printhead 600 motion along the printing path 606. Printhead 600 is the subassembly of Pen 120 (FIG. 1~3, 5) configured to discharge ink objects in the print zone 140. Nozzle pattern 610 is comprised of a plurality of nozzles 620~639 (illustrated as circles) configured in two columns, a plurality of nozzle 620~629 and a plurality of nozzles 630~639, respectively. Individual nozzles are configured with shared interconnection addresses, 640~649, such that a plurality are interconnected on each respective address, enabling a plurality of interconnected nozzles to fire with the same address. For example, address A 640 fires nozzle 620 which also shares interconnection with and fires nozzles 623 and 627; address B 942 shares and fires nozzles 621, 624 and 628; and addresses C through F 644~649 share and fire similarly interconnected nozzles, respectively, as illustrated in FIG. 6. This configuration is used to distribute and more evenly dissipate nozzle firing and especially thermal energy over the nozzle semiconductor materials. A maximum individual nozzle firing frequency exists due to the limitations in the thermal properties of the pen firing materials used and the fluidic properties of inks discharged during pen firing. Ink jet pen designers work around these limitations by grouping the nozzles such that thermal properties are minimized and ink fluid discharge is maximized for the typical use in orthogonal printing. Typical commercially available pens, depending upon the volume of ink discharged per nozzle, can fire at rates of 5-12 kHz, and can thus recover after firing no earlier than every 80 microseconds.

Figure 7:
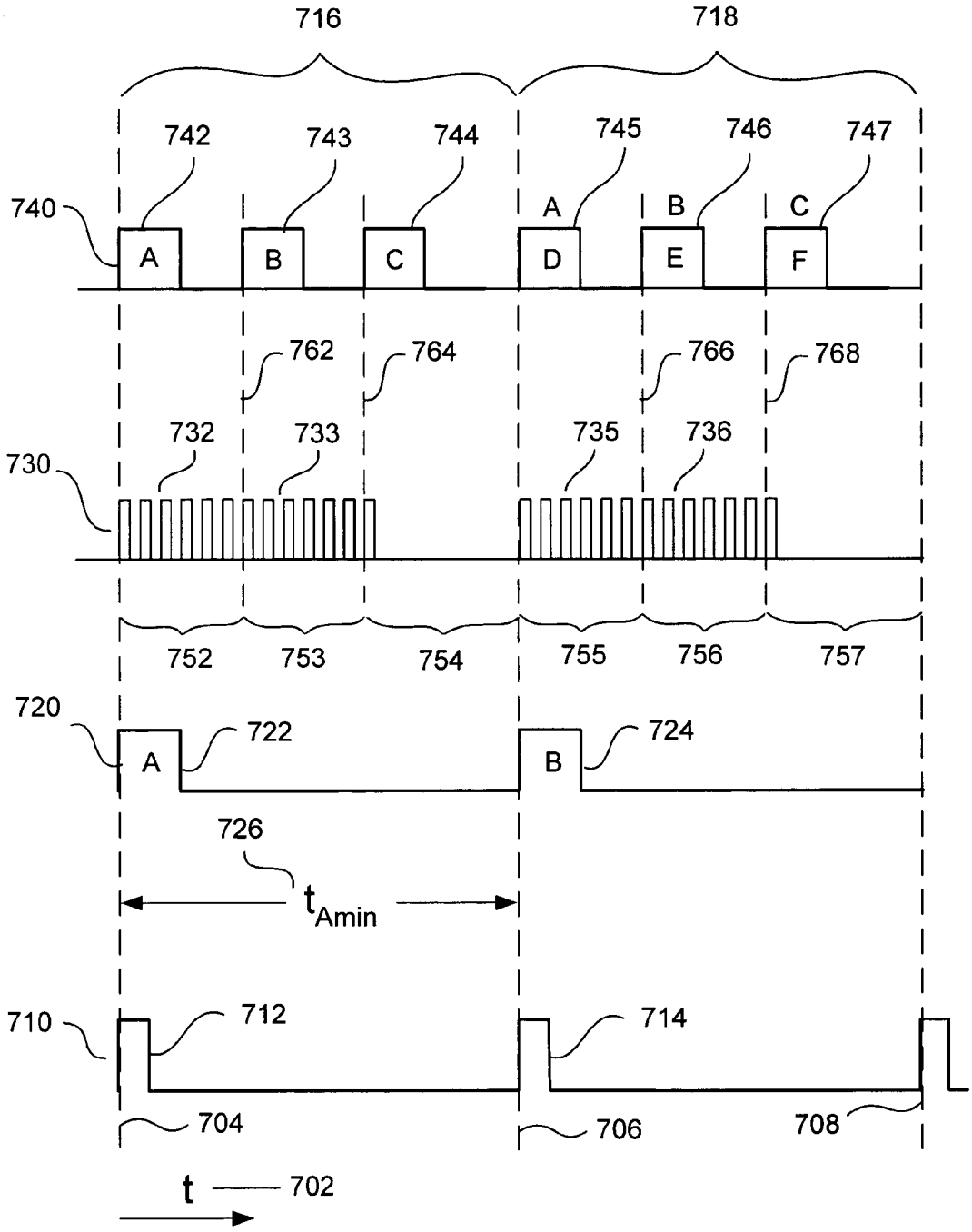
FIG. 7 represents several supportive and descriptive waveform patterns for the fill-clock interleaving embodiment of the present invention.

FIG. 7 represents several waveforms that illustrate optimization of pen firing for radial printing. Time t 702 is represented along the horizontal axis and several waveforms 710, 720, 730 and 740 are represented vertically. Waveform 710 represents the angular position signal for a radial print system, typically output by encoder 340 (FIG. 3) and conditioned by the Media Rotation Synchronization System 304 (FIGS. 3 and 5). The period 716 (or 718) between these signals for radial printing is determined by the encoder counts, typically between 5,000 and 20,000 counts per revolution, which corresponds approximately to a 300 to 1200 DPI annular resolution, respectively. In general, the radial printing system is dependant upon adequate frequency encoder sources (waveform 710). When this is not available, other methods may be used for providing synthesized or generated higher-resolution encoder pulses from lower-frequency sources. Detailed information on determining or generating angular position information for radial printing is disclosed in U.S. Pat. No. 6,736,475 issued May 18, 2004 and co-pending U.S. Provisional Application No. 60/566,468, filed Apr. 28, 2004, both referenced application and patent are hereby incorporated herein by reference in their entirety for all purposes.

In addition to encoder signal frequency, the minimum nozzle firing time $t_{Amin}$ 726 of every 80 microseconds or later, may control how quickly the radial print system can print. For example, waveform 720 illustrates a typical printing frequency while radially printing on the media 100. Firing nozzle A 722 at time 704 limits the pen from again firing nozzle A until time 706; thus $t_{Amin}$ 726 is greater than or equal to the pen nozzle firing frequency period, 716. The previously described embodiments above, DELAYED-PRINTING INTERLEAVING and HIGH-SPIN-RATE INTERLEAVING, disclose methods and apparatus to address interleave printing under the nozzle firing limitations using synchronous angular position waveforms 710. The present embodiment, FILL-CLOCK INTERLEAVING, will now be explained in more depth, which optimizes pen-firing rates in spite of the aforementioned firing limitations.

The present embodiment may be configured to interleave radial print by using a plurality of fill-clocks 730 (FIG. 7) to synthesis a plurality of angular position fill clocks 762~768 to augment the normal angular position information from the encoder signal waveform 710. The radial print device controller 502 (FIG. 5) in turn fires otherwise dormant nozzles (depicted in waveform 740 with addresses 743, 744, 746, and 747) and thus yield effectively higher pen-firing frequencies than using only the primary angular position clock 710 used to generate firing pulse stream 720. Hardware Timing and Control Logic 506 (FIG. 5) may be configured to synthesis a plurality of higher-frequency fill clocks 740 optimized to make full use of latent but ready-to-fire nozzles. The logic 506 so configured may consist of implementing linear interpolation through the use of oscillators and counters to logically combine its output with the primary angular position clock 710 to generate all available pen-firing fill clocks 740; these may be implemented in a field-programmable gate array or ASIC. By way of example, FIG. 7 periods 716 and 718 represent angular position clock pulses that may be used to fire nozzles address A during pulse 722, and either A again, or B or any other nozzle address during pulse 724, respectively. Referring again to FIG. 6, recall that firing a nozzle address actually fires a plurality of individual nozzles, such as 620, 623, and 627, respectively, when firing a nozzle address, such as A 640. Thus groups of a plurality of nozzles fire when nozzle firing addresses 640~649 are asserted.

Fill-clock interleaving may be achieved by using the angular position information pulses 710 from encoder 340 to trigger (e.g., synchronously) higher frequency counters to fire (e.g., asynchronously) additional address groups of nozzles in between synchronous angular positions pulses 710. Nozzle address group A 742 fires and then must wait period 716 before firing again a position 745. However, non-address group A nozzles 743~747 may be fired as early as they are in a suitable angular position or an offset of a suitable angular position available. Fill clock pulses 730 are used to time when the each nozzle address group fires. For example, during the angular position period 716, pulses 732 during period 752 generate fill clock 762; pulses 733 during period 753 generates fill clock 764; and a slack period 754 fills in the remainder time until the next synchronizations encoder pulse 706. Similarly, during the angular position period 718, pulses 735 during period 755 generates fill clock 766; pulses 736 during period 756 generates fill clock 768; and a slack period 754 fills in the remainder time until the next synchronizations encoder pulse 708; and the stream may continue similarly thereon. Thus, depending upon the characteristics of the pen 120 used in designing a radial print system, fill-clock interleaving 740 may be utilized to asynchronously optimize pen firing over the spinning media 100, as referenced from the synchronous instantaneous angular position information source 710. Any numbers of combinations or permutations of fill pulses and slack periods may be used to achieve more optimal fill-clock interleaving in radial printing systems.

Other embodiments, using similar methods for interleaving for radial printing are similarly contemplated in various combinations and permutations. For example, fill-clock interleaving may be combined with high-spin-rate interleaving to optimize printing on media at higher spin rates; or fill-clock interleaving may be combined with delayed-printing interleaving to optimize printing on slowly spinning media. While this invention has been described in terms of several preferred embodiments, there are alterations, permutations, and equivalents, which fall within the scope of this invention. It is therefore intended that the following appended claims be interpreted as including all such alterations, permutations, and equivalents as fall within the true spirit and scope of the present invention.

What is claimed is:

1. A method of printing onto a rotating media with a plurality of nozzles, comprising:

receiving an angular position signal with a plurality of angular position pulses;

synthesizing a plurality of fill clocks based on the plurality of angular position pulses, wherein the fill clocks include at least a first fill clock for firing a first set of the plurality of nozzles and a second fill clock for firing a second set of the plurality of nozzles, wherein the first fill clock is synthesized so as to specify that the period of time between each firing of the first set of nozzles is equal to or greater than a minimum nozzle firing time associated with the plurality of nozzles and wherein the second fill clock is synthesized so as to specify that the period of time between each firing of the second set of nozzles is equal to or greater than the minimum nozzle firing time, and wherein the first and second fill clocks are synthesized so that the period between the firing of the first and second set of nozzles is less than the minimum nozzle firing time;

firing the first set of nozzles based on the first fill clock; and firing the second set of nozzles based on the second fill clock.

2. The method of claim 1, wherein each angular position pulse corresponds to an equal number of fill clocks.

3. The method of claim 1, wherein the angular position signal is based from a frequency source producing a plurality of counts.

4. The method of claim 3, wherein the frequency source is an encoder.

5. The method of claim 3, wherein each angular position pulse defines a period of the angular position signal, the period of the angular position signal comprising between 5,000 and 20,000 counts per revolution of the rotating media.

6. The method of claim 1, wherein synthesizing the plurality of fill clocks includes using linear interpolation.

7. The method of claim 1, wherein the first and second sets of nozzles are different.

8. The method of claim 1, wherein the first and second fill clocks are periodic.

9. The method of claim 1, wherein the first and second fill clocks are synthesized so as to interleave the firings of the first set of nozzles with the firings of the second set of nozzles.

10. The method as recited in claim 9, wherein the fill clocks include a plurality of fill clocks for firing a plurality of different sets of the plurality of nozzles, wherein each fill clock is synthesized so as to specify that the period of time between each firing of its corresponding set of nozzles is equal to or greater than the minimum firing time, the method further comprising firing each set of the different sets of nozzles based on the different fill clocks.

11. The method as recited in claim 10, where the fill clocks are synthesized so as to sequentially fire all of the sets of different nozzles within a period of the angular pulses.

12. A printing system for printing onto a rotating media, comprising:

a rotation mechanism for rotating the media at a selected rotation speed;

a dispensement mechanism for dispensing ink onto the media while the media is rotating under the dispensement mechanism, the dispensement mechanism including a plurality of nozzles; and a controller configured to:

receive an angular position signal with a plurality of angular position pulses;

synthesize a plurality of fill clocks based on the plurality of angular position pulses, wherein the fill clocks include at least a first fill clock for firing a first set of the plurality of nozzles and a second fill clock for firing a second set of the plurality of nozzles, wherein the first fill clock is synthesized so as to specify that the period of time between each firing of the first set of nozzles is equal to or greater than a minimum nozzle firing time associated with the plurality of nozzles and wherein the second fill clock is synthesized so as to specify that the period of time between each firing of the second set of nozzles is equal to or greater than the minimum nozzle firing time, and wherein the first and second fill clocks are synthesized so that the period between the firing of the first and second set of nozzles is less than the minimum nozzle firing time;

fire the first set of nozzles based on the first fill clock; and fire the second set of nozzles based on the second fill clock.

13. The printing system of claim 12, wherein each angular position pulse corresponds to an equal number of fill clocks.

14. The printing system of claim 12, wherein the angular position signal is based from a frequency source producing a plurality of counts.

15. The printing system of claim 14, wherein the frequency source is an encoder.

16. The printing system of claim 14, wherein each angular position pulse defines a period of the angular position signal, the period of the angular position signal comprising between 5,000 and 20,000 counts per revolution of the rotating media.

17. The printing system of claim 12, wherein the controller is configured to synthesize the plurality of fill clocks using linear interpolation.

18. The printing system of claim 12, wherein the first and second sets of nozzles are different.

19. The printing system of claim 12, wherein the first and second fill clocks are periodic.

20. The printing system of claim 12, wherein the first and second sets of nozzles are aligned parallel to a radial axis of the rotating media.

21. The printing system of claim 12, wherein the first and second fill clocks are synthesized so as to interleave the firings of the first set of nozzles with the firings of the second set of nozzles.

22. The printing system as recited in claim 21, wherein the fill clocks include a plurality of fill clocks for firing a plurality of different sets of the plurality of nozzles, wherein each fill clock is synthesized so as to specify that the period of time between each firing of its corresponding set of nozzles is equal to or greater than the minimum firing time, wherein the controller is configured to fire each set of the different sets of nozzles based on the different fill clocks.

23. The printing system as recited in claim 22, where the fill clocks are synthesized so as to sequentially fire all of the sets of different nozzles within a period of the angular pulses.

* * * * *